US005932821A

United States Patent [19]

Kitajima et al.

[11] Patent Number: 5,932,821

[45] Date of Patent: Aug. 3, 1999

[54] HAMMER HEAD FOR PIANO AND METHOD OF MANUFACTURING SAME

[75] Inventors: Riichi Kitajima; Muneo Ishida, both of Hamamatsu, Japan

[73] Assignee: Kabushiki Kaisha Kawai Gakki Seisakusho, Shizuoka-ken, Japan

[21] Appl. No.: 09/017,625

[22] Filed: Feb. 2, 1998

[30] Foreign Application Priority Data

Feb. 3, 1997 [JP] Japan ..... 9-034370

[51] Int. Cl.[6] ..... G10C 3/18

[52] U.S. Cl. ..... 84/254

[58] Field of Search ..... 84/254

[56] References Cited

U.S. PATENT DOCUMENTS 5,125,310 6/1992 Lombino ..... 84/254

*Primary Examiner*—William M. Shoop, Jr.
*Assistant Examiner*—Shih-Yung Hsieh
*Attorney, Agent, or Firm*—Evenson, McKeown, Edwards & Lenahan PLLC

[57] ABSTRACT

A hammer head for a piano which is simple in structure and is capable of maintaining a humidity preventive effect for a longer time. The hammer head comprises a hammer body having a hammer felt including two flat surfaces substantially parallel to each other, and a string striking portion for striking a string, and a humidity preventive film adhered on the two flat surfaces of the hammer felt of the hammer body so as to cover the flat surfaces. A method for manufacturing such hammer heads at a low cost is also provided.

10 Claims, 4 Drawing Sheets

HAMMER HEAD FOR PIANO AND METHOD OF MANUFACTURING SAME

BACKGROUND OF THE INVENTION

1. Field of the Invention

The present invention relates generally to a hammer head for striking a string in an acoustic piano, and more particularly to a moisture-proof hammer head for a piano and a method of manufacturing same.

2. Description of the Related Art

As is well known in the art, a hammer head for an acoustic piano is composed of a shaft-like hammer wood made of a solid woody material and a hammer felt made of wool felt and adhered around a front end portion of the hammer wood. The hammer head is rotatably mounted at a location above and behind an associated key, and is driven to rotate by an action in response to a depression of the associated key such that a front end portion of the hammer felt strikes a string stretched therebehind to cause vibration of the string, thus generating acoustic piano sound. In addition, for providing satisfactory piano sound characteristics in accordance with particular sound ranges, the hardness of the hammer felt is set lower toward the lower sound side and higher toward the higher sound side.

In the hammer head as mentioned above, the hammer felt is highly susceptible to absorbing moisture (humidity), and the hammer felt, when absorbing moisture, exhibits a lower hardness, thus failing to provide a predetermined piano sound characteristic. For example, a damped hammer felt will reduce dilatation of piano sound. Thus, as a hammer head for preventing such an inconvenience, there is conventionally known a hammer head having a resin impregnated in a half portion of a hammer felt on the base end side (near a hammer wood). The impregnated resin provides a moisture-proof capability for the hammer felt. In addition, a plurality of hammer heads are wrapped together with a vinyl sheet or the like for the same purpose when a piano is shipped.

The prior art technique for impregnating a resin into a hammer felt for preventing the hammer felt from absorbing moisture, however, implies several problems. For example, the resin itself causes a high material cost. Also, a manufacturing period becomes longer because subsequent steps must be pending until the impregnated resin is dried, so that a manufacturing cost of the hammer head is increased. While the method of wrapping hammer heads with a vinyl sheet or the like upon shipping in turn is simple and inexpensive, its humidity preventive effect is limited only from shipment to arrival of a piano at a client, and is not available after the client begins to use the piano.

OBJECT AND SUMMARY OF THE INVENTION

The present invention has been made to solve the problems mentioned above, and its object is to provide a hammer head for a piano which is capable of maintaining a humidity preventive effect for a longer time in a simple structure, and a method of manufacturing hammer heads for a piano which is capable of manufacturing the hammer head as mentioned above at a low cost.

To achieve the above object, in a first aspect of the present invention, there is provided a hammer head for a piano which comprises a hammer body having a hammer felt including two flat surfaces substantially parallel to each other and a string striking portion for striking a string, and a humidity preventive film, made of a humidity preventive material, adhered on the two flat surfaces of the hammer felt so as to cover the two flat surfaces.

According to this structure, since the two flat surfaces, main surfaces of the hammer felt, are covered with the humidity preventive film, a humidity preventive effect can be provided. In addition, since the humidity preventive film is used as a humidity preventive material, the humidity preventive effect can be maintained for a longer time, and a manufacturing cost can be reduced as compared with a hammer felt impregnated with a resin. Further, since the humidity preventive film need only be adhered on the surface of the hammer felt, the humidity preventive effect can be provided in a simpler structure which may be readily manufactured in a shorter time, as compared with a hammer felt impregnated with a resin, thereby making it possible to reduce the manufacturing cost.

Preferably, in this case, the humidity preventive film is adhered on portions of the two flat surfaces of the hammer felt except for the string striking portion. In this structure, since the humidity preventive film is adhered to cover the hammer felt except for the string striking portion which actually strikes the string, it can be ensured to prevent the humidity preventive film from adversely affecting the sound generated from the piano.

Also, in a second aspect of the present invention, there is provided a method of manufacturing hammer heads for a piano which comprises the steps of preparing a plurality of hammer bodies each having a hammer felt including two flat surfaces substantially parallel to each other and a string striking portion for striking a string, preparing a flat pattern cutting base having a plurality of recesses arranged side by side, wherein each recess has a shape and a dimension substantially matching with the flat surface of the hammer felt, and a depth smaller than a thickness of the hammer felt, preparing a humidity preventive film having an adhesive applied on a rear surface thereof, inserting the plurality of hammer bodies into the plurality of recesses of the pattern cutting base with the hammer felts protruding upwardly, applying the humidity preventive film over the plurality of hammer bodies inserted into the recesses, with the rear surface of the humidity preventive film facing downwardly, so as to cover the flat surfaces of a plurality of the hammer felts, and rolling a roller over the applied humidity preventive film with pressure to adhere the humidity preventive film on the flat surfaces of the hammer felts and to cut the humidity preventive film by peripheral edges of the flat surfaces of the hammer felts.

According to this method, since the humidity preventive film can be simultaneously adhered to a plurality of hammer felts only by inserting a plurality of hammer bodies into a plurality of recesses of the pattern cutting base, with the hammer felts protruding upwardly, and rolling the roller on the humidity preventive film, a plurality of the foregoing hammer heads can be readily manufactured at a low cost. In addition, since the hammer felts slightly protrude from the pattern cutting base, and the roller is rolled thereover with pressure, the adhesive film is automatically cut (patterned) along the peripheral edge of the flat surface of each hammer felt. In this way, since the peripheral edges of the hammer felts themselves are utilized to cut and pattern the humidity preventive film, a separate shaping means is not required, thereby simplifying machines involved in the manufacturing and consequently achieving a further reduction in manufacturing cost.

Preferably, in this case, the humidity preventive film further comprises a stripping film adhered on the surface thereof through a stripping agent, and the method further comprising the step of stripping the stripping film from the humidity preventive film after the step of adhering and cutting the humidity preventive film.

With this structure, since the roller is rolled over the stripping film without directly contacting the humidity preventive film in the step of adhering and cutting the humidity preventive film, the surface of the humidity preventive film can be securely prevented from being damaged by the rolling action of the roller, thereby making it possible to maintain a favorably finished surface of the humidity preventive film after the stripping film is stripped from the adhesive film.

In the foregoing cases, the roller preferably has hard rubber wrapped around a peripheral surface thereof.

With this structure, since the hard rubber wrapped around the peripheral surface of the roller absorbs ruggedness of the flat surface of the hammer felt, the adhesive film can be appropriately adhered and cut without fail.

Also preferably, the foregoing method further comprises the step of applying the humidity preventive film along the plurality of recesses of the pattern cutting base, prior to the step of inserting the hammer bodies, and the step of adhering and cutting the humidity preventive film comprises simultaneously adhering two sheets of the humidity preventive films to the two flat surfaces of the hammer felts and cutting the humidity preventive films by the respective flat surfaces of the hammer felts.

With this structure, since two humidity preventive films can be adhered to and cut by the two flat surfaces of each hammer felt, it is possible to significantly improve a manufacturing efficiency and hence realize a further reduction in manufacturing cost.

DESCRIPTION OF THE PREFERRED EMBODIMENTS

Figure 1:
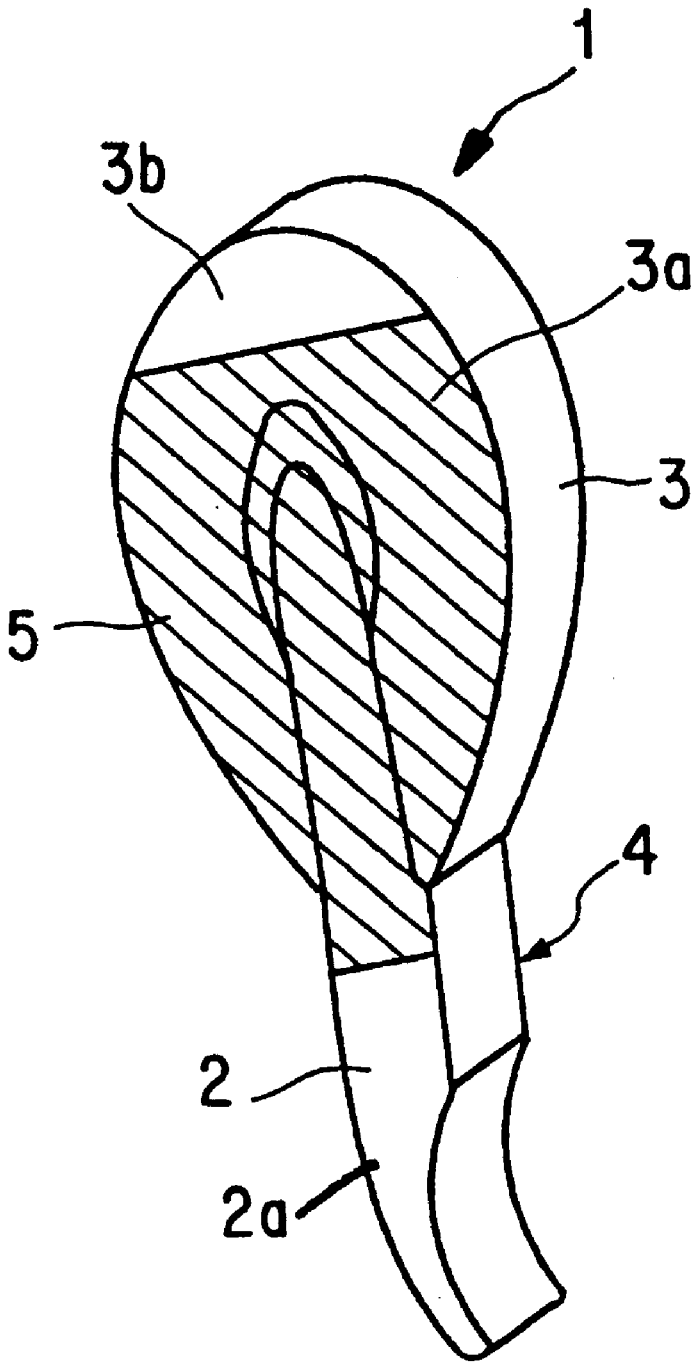
FIG. 1 is a perspective view of a hammer head for a piano according to one embodiment of the present invention.

The present invention will hereinafter be described in connection with its preferred embodiment with reference to the accompanying drawings. FIG. 1 illustrates a hammer head for a piano to which the present invention is applied. A hammer head 1 comprises a hammer body 4 having a hammer wood 2 and a hammer felt 3, and a humidity preventive film 5 adhered to side surfaces of the hammer felt 3.

The hammer body 4, having substantially the same structure as a conventional hammer head, may be made of a solid woody material such as mahogany or the like, and is formed in a shaft-like shape. The hammer felt 3, which may be made of a wool felt, is wrapped around a front end portion of the hammer wood 2 so as to cover same, and adhered thereto. The hammer felt 3 has (flat) side surfaces in a predetermined oval shape such that two side surfaces 3*a*, substantially parallel to each other, are coplanar with the side surfaces 2*a* of the hammer wood 2 (in FIG. 1, only one side is illustrated).

The humidity preventive film 5 is made of a humidity preventive material such as an acrylic film or the like. As indicated by hatching in FIG. 1, the humidity preventive film 5 is adhered to cover both side surfaces 3*a* of the hammer felt 3 except for a string striking portion 3*b* as well as a portion of the hammer wood 2 (in FIG. 1, only one side is illustrated).

Figure 2:
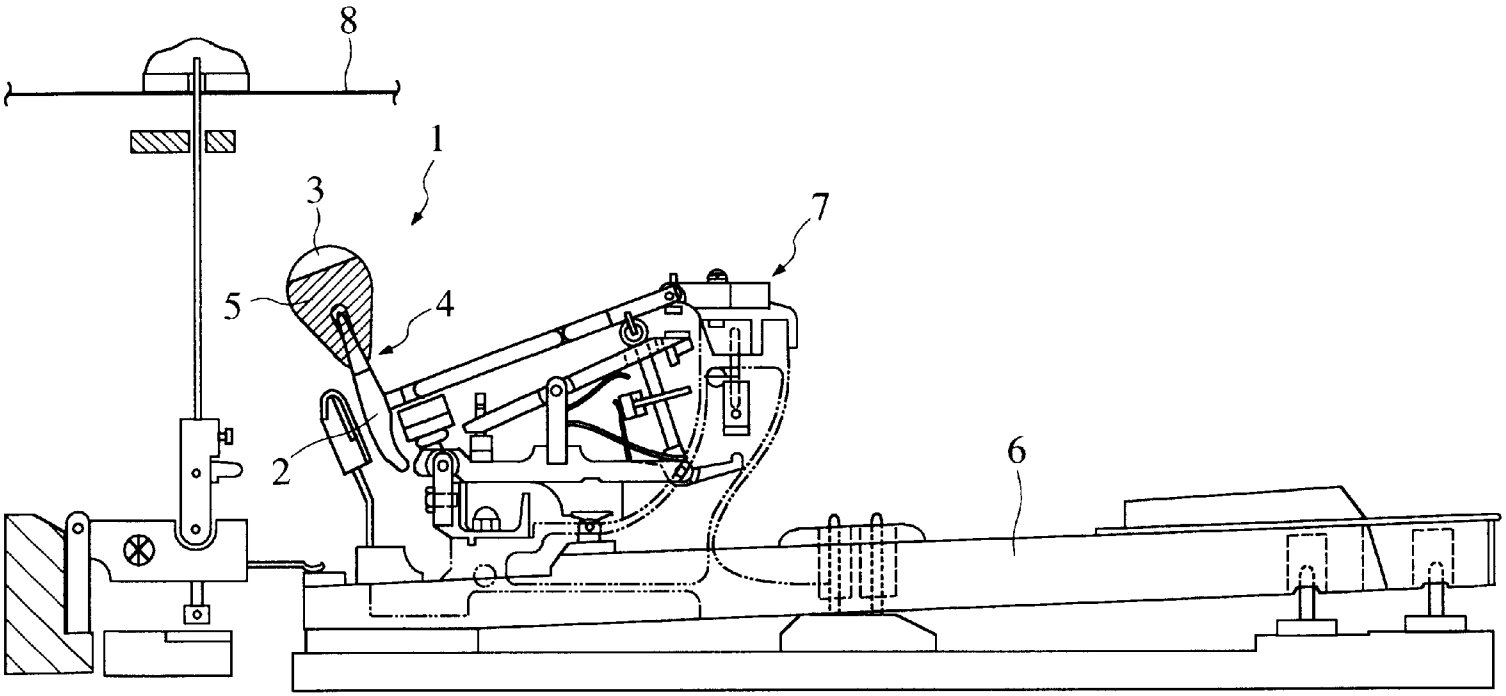
FIG. 2 is a side view of a keyboard mechanism for a grand piano which incorporates the hammer head of FIG. 1.
Figure 3:
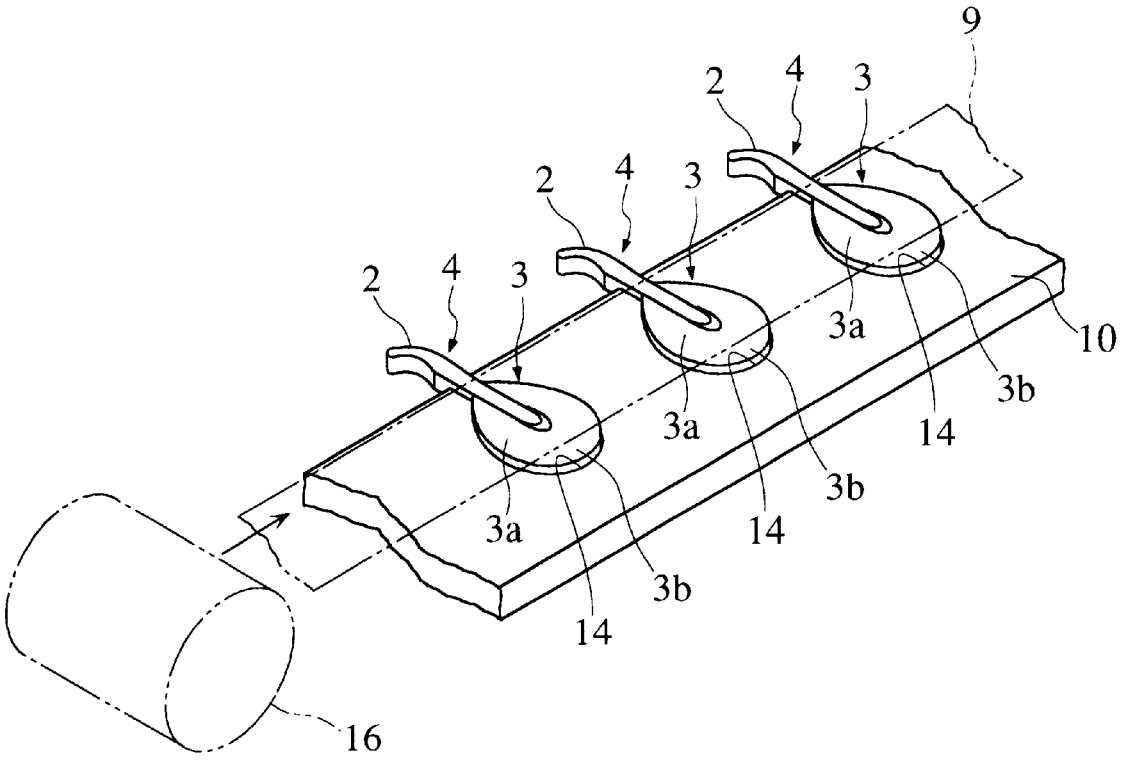
FIG. 3 is a perspective view showing a method of manufacturing hammer heads for a grand piano according to one embodiment of the present invention.
Figure 4A:
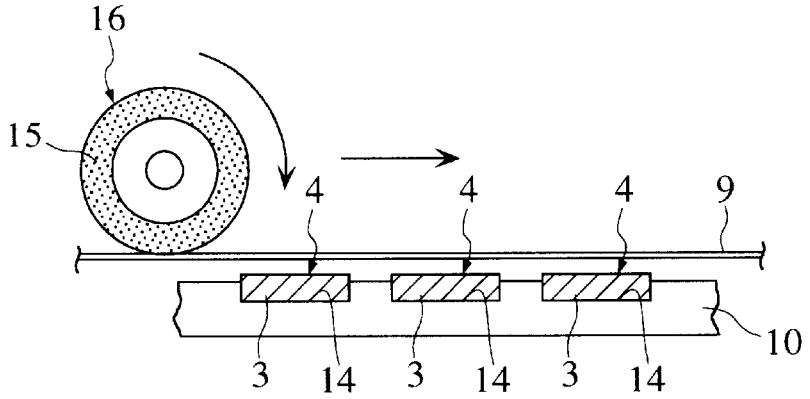
FIGS. 4A and 4B are diagrams illustrating a procedure of the manufacturing method in FIG. 3.
Figure 4B:
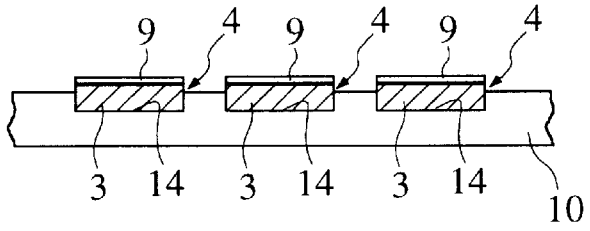
Figure 5:
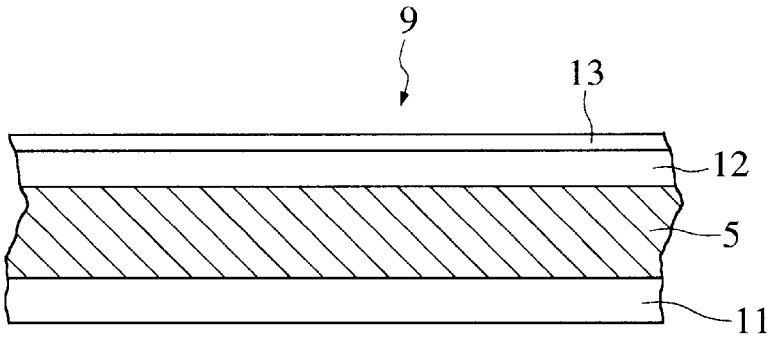
FIG. 5 is a cross-sectional view illustrating the structure of an adhesive film.

Referring next to FIG. 2, the hammer head 1 is rotatably mounted at a location above and behind an associated key 6, and is driven to rotate upwardly by an action 7 in response to a depression of the key 6 such that the string striking portion 3*b* of the hammer felt 3 strikes a string 8 stretched horizontally above the hammer head 1 to cause vibration of the string 8, thus generating acoustic piano sound.

According to the hammer head 1 constructed as described above, since the two side surfaces 3*a*, principal surfaces of the hammer felt 3, are covered with the humidity preventive film 5, a humidity preventive effect can be provided. Of course, the humidity preventive film 5 may be adhered not only on the side surfaces 3*a* but also on the peripheral surface of the hammer felt 3. In addition, since the humidity preventive film 5 is used as a humidity preventive material, the humidity preventive effect can be maintained for a longer time, and a manufacturing cost can be reduced as compared with a hammer felt impregnated with a resin.

Further, since the humidity preventive film 5 need only be adhered on the side surfaces 3*a* of the hammer felt 3, the humidity preventive effect can be provided in a simpler structure which may be readily manufactured in a shorter time, as compared with a hammer felt impregnated with a resin, thereby making it possible to reduce the manufacturing cost. Furthermore, since the humidity preventive film 5 is adhered to cover the hammer felt 3 except for the string striking portion 3*b* which actually strikes the string 8, it can be ensured to prevent the humidity preventive film 5 from adversely affecting the sound generated from the piano.

Turning next to FIGS. 3 and 4A–4C illustrating an exemplary method of manufacturing the hammer head 1 constructed as described above, how the hammer head 1 is manufactured will be described below. In the illustrated method, hammer heads 1 constructed as described above, an adhesive film 9 including the humidity preventive film 5, and a pattern cutting plate (pattern cutting base) 10 are separately prepared (a hammer body preparing step, a humidity preventive film preparing step, and a pattern cutting base preparing step).

The adhesive film 9 is an elongated tape-shaped film having a four-layer structure which comprises a humidity preventive film 5 made of an acrylic film or the like; an adhesive 11 of, for example, a hot melt type, applied over the rear surface of the humidity preventive film 5; a stripping agent 12 made of silicone or the like applied on the main surface of the humidity preventive film 5; and a stripping film 13, made of polyester or the like, constituting the outermost layer. As will be described later, the adhesive film 9 is adhered to the hammer felt 3 with the adhesive 11 in this four-layer state, and then the stripping film 13 is stripped from the stripping agent 12 to only leave the humidity preventive film 5 on the hammer felt 3.

The pattern cutting plate 10 is provided, when the humidity preventive film 5 is adhered to the hammer felts 3, for cutting (patterning) the humidity preventive film 5 and adhering the cut humidity preventive film 5 on a plurality of hammer bodies 4 inserted into the pattern cutting plate 10. The pattern cutting plate 10 comprises a plurality of recesses 14 arranged side by side in the surface of an elongated plate. Each recess 14 has a shape and a dimension substantially matching with the side surface 3*a* of the hammer felt 3, and has a depth approximately two millimeters smaller than the thickness of the hammer felt 3 such that the hammer body 4 is just fitted into the recess 14 with the upper side surface 3*a* of the hammer felt 3 protruding approximately two millimeters from the surface of the pattern cutting base 10.

After the hammer bodies 4, the adhesive film 9 and the pattern cutting plate 10 have been prepared as mentioned above, the hammer bodies 4 are inserted into the respective recesses 14 such that the upper side surface 3*a* of the respective hammer felts 3 protrude approximately two millimeters from the surface of the pattern cutting plate 10 (a hammer body inserting step). Next, the adhesive film 9 is applied over the plurality of hammer bodies 4 with the adhesive 11 facing below such that the side surface 3*a* of the hammer felt 3 except for the string striking portion 3*b* and a portion of the hammer wood 2 are covered with the adhesive film 9 (a humidity preventive film applying step).

Next, a roller 16 having a silicone rubber (hard rubber) sheet 15 wrapped around the peripheral surface thereof is rolled over the applied adhesive film 9 with pressure to adhere the adhesive film 9 to the side surfaces 3*a* of the respective hammer felts 3 with the adhesive 11 (a humidity preventive film adhering and cutting step). In this event, since the hammer felts 3 slightly protrude from the pattern cutting plate 10, and the roller 16 is rolled with pressure, the adhesive film 9 is automatically cut (patterned) along the edge of the side surface 3*a* of each hammer felt 3 (see FIG. 4B). In addition, since the silicone rubber sheet 15 wrapped around the peripheral surface of the roller 16 absorbs possible ruggedness of the side surfaces 3*a* of the hammer felts 3, the adhesive film 9 can be appropriately adhered and cut without fail. In this way, the adhesion of the adhesive film 9 on one side surface 3*a* of each hammer felt 3 is completed.

Next, each hammer body 4 is turned upside down and inserted into an associated recess 14, and the foregoing steps are executed in a similar manner to adhere the adhesive film 9 on the other side surface 3*a* of the hammer felt 3. Finally, the stripping films 13 adhered on both side surfaces 3*a* of the hammer felts 3 are stripped from the respective adhesive films 9 through the stripping agents 12, thereby leaving only the humidity preventive films 5 on the respective side surfaces 3*a* of the hammer felt 3 to complete the hammer head 1 illustrated in FIG. 1.

According to the method of manufacturing hammer heads of this embodiment as described above, a plurality of hammer bodies 4 with the hammer felts 3 are inserted into a plurality of recesses 14, an adhesive film 9 is applied over the hammer felts 3, and a roller 16 is rolled over the adhesive film 9. Only with these steps, the humidity preventive film 5 can be simultaneously adhered on the hammer felts 3 of the plurality of hammer bodies 4, so that a plurality of hammer heads 1 can be simultaneously manufactured in a simple manner at a low cost. Particularly, since the peripheral edges of the hammer felts 3 themselves are utilized to cut and pattern the humidity preventive film 5, a separate shaping means is not required, thereby simplifying machines involved in the manufacturing and consequently achieving a further reduction in manufacturing cost.

Also, when the humidity preventive film 5 is adhered, the roller 16 is rolled over the stripping film 13 without directly contacting the humidity preventive film 5, the surface of the humidity preventive film 5 can be securely prevented from being damaged by the rolling action of the roller 16, thereby making it possible to maintain a favorably finished surface of the humidity preventive film 5 after the stripping film 13 is stripped from the adhesive film 9.

It should be noted that the present invention is not limited to the foregoing specific embodiments but may be implemented in a variety of aspects. For example, while in the foregoing embodiment, the humidity preventive film 5 is adhered to one of the side surfaces 3*a* of the hammer felt 3 at a time, the adhesive film 9 may be previously placed along a plurality of recesses 14 before the hammer bodies 4 with the hammer felts 3 are inserted into associated recesses 14 so that the humidity preventive films 5 can be simultaneously adhered on both side surfaces 3*a* of the respective hammer felts 3. This will allow for a significantly improved manufacturing efficiency and a further reduction in manufacturing cost.

Moreover, while the foregoing embodiment has been described in connection with a grand piano taken as an example, it goes without saying that the present invention may be applied to a hammer head for an upright piano. Also, the materials for the respective components are not limited to those illustrated above but may be arbitrarily selected from any appropriate candidates. Further modifications may be made in structural details as required without departing from the spirit and scope of the present invention.

As described above in detail, the hammer head for a piano of the present invention is advantageously simple in structure and capable of maintaining a humidity preventive effect for a longer time, while the method of manufacturing hammer heads for a piano of the present invention can advantageously manufacture a large number of such hammer heads simultaneously at a low cost.

What is claimed is:

1. A hammer head for a piano comprising:

a hammer body having a hammer felt including two flat surfaces substantially parallel to each other and a string striking portion for striking a string; and humidity preventive films, made of a humidity preventive material, adhered on said two flat surfaces of said hammer felt so as to cover said two flat surfaces.

2. A hammer head for a piano according to claim 1, wherein said humidity preventive films are adhered on portions of said two flat surfaces of said hammer felt except for said string striking portion.

3. A method of manufacturing hammer heads for a piano comprising the steps of:

providing a plurality of hammer bodies each having a hammer felt including two flat surfaces substantially parallel to each other and a string striking portion for striking a string;

providing a flat pattern cutting plate having a plurality of recesses arranged side by side, each said recess having a shape and a dimension substantially matching with said flat surface of said hammer felt, and a depth smaller than a thickness of said hammer felt;

providing a humidity preventive film having an adhesive applied on a rear surface thereof;

inserting said plurality of hammer bodies into said plurality of recesses of said pattern cutting plate with said hammer felts being protruding upwardly;

applying said humidity preventive film over said plurality of hammer bodies inserted into said recesses, with said rear surface of said humidity preventive film facing downwardly, so as to cover said flat surfaces of a plurality of said hammer felts; and rolling a roller over said applied humidity preventive film with pressure to adhere said humidity preventive film on said flat surfaces of said hammer felts and to cut said humidity preventive film by peripheral edges of said flat surfaces of said hammer felts.

4. A method according to claim 3, wherein said humidity preventive film further comprises a stripping film adhered on the surface thereof through a stripping agent, and said method further comprises the step of stripping said stripping film from said humidity preventive film after said step of adhering and cutting said humidity preventive film.

5. A method according to claim 4, wherein said roller has hard rubber wrapped around a peripheral surface thereof.

6. A method according to claim 5, further comprising the step of applying said humidity preventive film along said plurality of recesses of said pattern cutting plate, prior to said step of inserting said hammer bodies, wherein said step of adhering and cutting said humidity preventive film comprises simultaneously adhering two sheets of said humidity preventive films to said two flat surfaces of said hammer felts and cutting said humidity preventive films by said respective flat surfaces of said hammer felts.

7. A method according to claim 4, further comprising the step of applying said humidity preventive film along said plurality of recesses of said pattern cutting plate, prior to said step of inserting said hammer bodies, wherein said step of adhering and cutting said humidity preventive film comprises simultaneously adhering two sheets of said humidity preventive films to said two flat surfaces of said hammer felts and cutting said humidity preventive films by said respective flat surfaces of said hammer felts.

8. A method according to claim 3, wherein said roller has hard rubber wrapped around a peripheral surface thereof.

9. A method according to claim 8, further comprising the step of applying said humidity preventive film along said plurality of recesses of said pattern cutting plate, prior to said step of inserting said hammer bodies, wherein said step of adhering and cutting said humidity preventive film comprises simultaneously adhering two sheets of said humidity preventive films to said two flat surfaces of said hammer felts and cutting said humidity preventive films by said respective flat surfaces of said hammer felts.

10. A method according to claim 3, further comprising the step of applying said humidity preventive film along said plurality of recesses of said pattern cutting plate, prior to said step of inserting said hammer bodies, wherein said step of adhering and cutting said humidity preventive film comprises simultaneously adhering two sheets of said humidity preventive films to said two flat surfaces of said hammer felts and cutting said humidity preventive films by said respective flat surfaces of said hammer felts.

* * * * *